US008829352B2

(12) United States Patent
Auvray et al.

(10) Patent No.: US 8,829,352 B2
(45) Date of Patent: Sep. 9, 2014

(54) LAN CABLE WITH DUAL LAYER PEI/FRPP INSULATION FOR PRIMARY CONDUCTORS

(75) Inventors: Thierry Auvray, Lancaster, PA (US); Paul Kroushl, Lancaster, PA (US)

(73) Assignee: NEXANS, Paris (FR)

( * ) Notice: Subject to any disclaimer, the term of this patent is extended or adjusted under 35 U.S.C. 154(b) by 151 days.

(21) Appl. No.: 13/118,807

(22) Filed: May 31, 2011

(65) Prior Publication Data

US 2012/0305285 A1 Dec. 6, 2012

(51) Int. Cl.

| | |
|---|---|
| ***H01B 7/29*** | (2006.01) |
| ***H01B 7/295*** | (2006.01) |
| *H01B 11/02* | (2006.01) |

(52) U.S. Cl.

CPC ..... *H01B 7/295* (2013.01); *H01B 11/02* (2013.01)

USPC ..... 174/121 A

(58) Field of Classification Search

USPC ..... 173/113 R, 120 R, 121 A; 174/113 R, 174/120 R, 121 A

See application file for complete search history.

(56) References Cited

U.S. PATENT DOCUMENTS

| | | | | |
|---|---|---|---|---|
| 4,412,094 | A * | 10/1983 | Dougherty et al. | 174/110 F |
| 4,588,779 | A * | 5/1986 | Smearing | 525/180 |
| 5,521,009 | A * | 5/1996 | Ishikawa et al. | 428/375 |
| 5,563,377 | A | 10/1996 | Arpin et al. | |
| 6,403,889 | B1 * | 6/2002 | Mehan et al. | 174/120 R |
| 2005/0056454 | A1 * | 3/2005 | Clark | 174/113 R |
| 2005/0092514 | A1 * | 5/2005 | Kenny et al. | 174/113 R |

FOREIGN PATENT DOCUMENTS

| | | | |
|---|---|---|---|
| JP | 03-159008 | * | 7/1991 |

* cited by examiner

*Primary Examiner* — Chau N Nguyen
(74) *Attorney, Agent, or Firm* — Sofer & Haroun, LLP

(57) ABSTRACT

A communications cable having a jacket and a plurality of twisted pairs, each twisted pair having two insulated conductors twisted around one another, where on at least one twisted pair, the insulation on the conductors of the pair is a two layer insulation with a first inner layer of polyolefin and a second outer layer of imide polymer.

5 Claims, 6 Drawing Sheets

LAN CABLE WITH DUAL LAYER PEI/FRPP INSULATION FOR PRIMARY CONDUCTORS

BACKGROUND

1. Field of the Invention

This application relates to cables. More particularly, this application relates to network cable insulation.

2. Description of Related Art

Communications cables are broadly grouped into two arrangements, fiber optic cables and metal conductor cables, each of which has their own unique set of construction parameters that affect the quality of the communication signals carried therethrough.

Regarding metal conductor cables, one typical arrangement is the LAN (Local Area Network) cable that is usually constructed of four pairs of twisted insulated copper conductors encased within a jacket. Other larger cables may employ more pairs of conductors.

In this typical four pair LAN cable construction, in addition to the outer jacket, each of the eight primary conductors are individually coated with an insulation layer. Special designs for LAN cables may include a cross-filler for better NEXT (Near End Cross Talk) performance.

Aside from electrical performance considerations, there are certain mechanical performance tests that need to be met. One such crucial test is the NFPA 262 flame test, which is a standard method of testing for flame travel and smoke generation in wires and cables that may be installed in air-handling spaces such as budding ductwork.

In this context, FEP (fluorinated Ethylene Polymer) resin, thanks to its outstanding electrical and flame performance, is a typical material choice for the LAN cable application, for use in the primary conductor insulation. Other fire resistant materials such FRPVC (Flame Resistant PVC) are used for the outer jacket as the balance of ruggedness versus electrical considerations are different for the outer jacket than for the primary insulation.

With respect to the use of FEP on the primary insulation however, because FEP resin is expensive and the source of supply is limited, it is desirable to reducing or replace the FEP using alternative materials.

One such prior art example, U.S. Pat. No. 5,563,377 illustrates a LAN cable where the insulation on each of the four pairs of primary conductors made of four insulated dual layers pairs where a smaller amount of FEP resin covers the primary insulation layer made of an olefin based flame retardant formulation, thus reducing the amount of FEP required.

OBJECTS AND SUMMARY

The present arrangement addresses the problems with the prior art and provides for a LAN cable that meets the required NFPA 262 flame test, without the use of FEP.

To this end, the present arrangement provides a communications cable having a jacket and a plurality of twisted pairs, each Misted pair having two insulated conductors twisted around one another. On at least one twisted pair, the insulation on the conductors of the pair is a two layer insulation with a first inner layer employing polyolefin and a second outer layer employing imide polymer.

BRIEF DESCRIPTION OF THE DRAWINGS

The present invention can be best understood through the following description and accompanying drawings, wherein.

DETAILED DESCRIPTION

Figure 1:
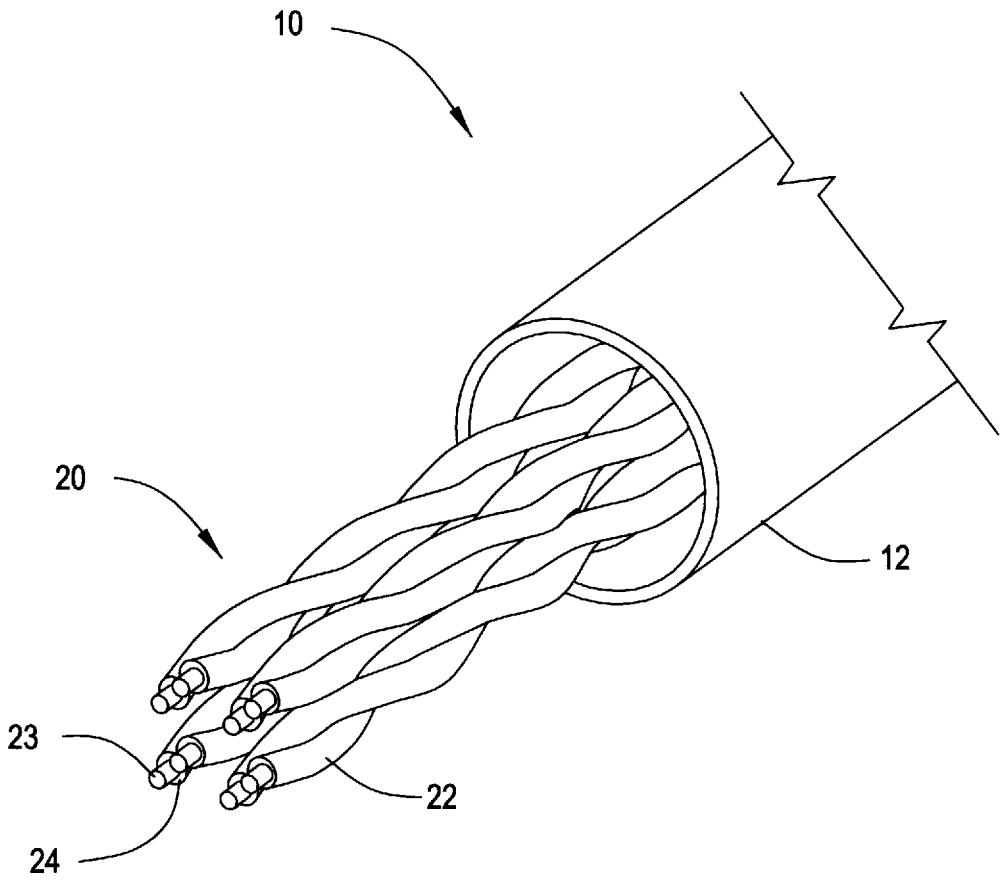
FIG. 1 shows an exemplary LAN cable according to the present arrangement.

In one embodiment as illustrated in FIG. 1, a LAN (Local Area Network) cable 10 is shown. For the purposes of illustration, the salient features of the present arrangement are described in the context of a LAN cable, however, the invention is not limited in this respect.

As shown in FIG. 1, LAN cable 10 has a jacket 12 constructed for example from FRPVC (Flame Retardant Poly-Vinyl Chloride). Within jacket 12 there are four twisted pairs 20. Each twisted pair is formed of two primary conductors 22 twisted around one another. As per FIG. 1, primary conductors 22 are made from a copper wire conductor 23 covered with insulation 24.

Figure 2:
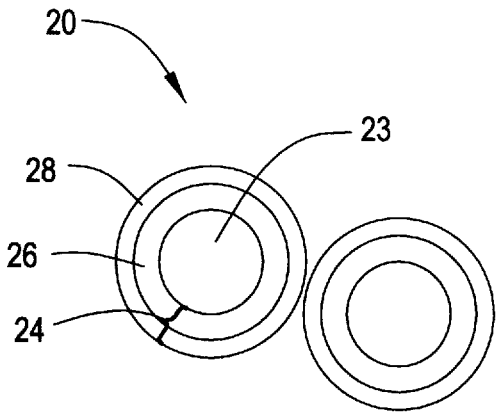
FIG. 2 shows an exemplary construction of one primary conductor of the LAN cable of FIG. 1, in accordance with one embodiment.

As illustrated in FIG. 2, copper wire conductor 23 may be covered with a two layer insulation. In this respect, insulation 24 is formed of a first inner layer 26 which may be made from a flame resistant olefin composition, preferably FRPP (Flame Resistant Polypropylene). The other portion of insulation 24 is an outer layer 28, extruded over inner layer 26 made from a flame resistant imide polymer, such as PEI (polyetherimide).

It is noted that normally, insulation 24 in a LAN cable would be a single layer of insulation (of one material). In the present arrangement as shown in FIG. 2, insulation 24 on pairs 20 is a two layer 26/28 insulation. As discussed in more detail below, it is understood that such two layer insulation as described above and shown in FIG. 2 may be used on one, more than one or all of the pairs 20 within a given cable 10.

Regarding the selection of polymers for insulation 24 as shown in FIGS. 1 and 2, Flame Resistant Polyolefins, and in particular FRPP is significantly less expensive than either the normal prior art FEP and even the above described PEI. However, although it is flame/smoke resistant, it is not as flame smoke resistant as either FEP or PEI.

PEI has excellent flame and smoke performance. However, it tends to be stiffer resulting in less cable flexibility and its dielectric constant is higher, which means the velocity of signal propagation through PEI insulated conductors is slower than through conductors insulated by FRPP. On the other hand, signal dissipation factor for PEI is lower than that of FRPP, which results in less signal attenuation.

In alternative arrangement, the use of other polymers of comparable flame resistance and electrical performance to PEI, including polyether sulfone, polyphenylene oxide, or combinations thereof with each other or with PEI, is contemplated.

Furthermore, it is noted that in order to improve metal release, processibility, aging, or flame and smoke performance, the PEI may contain organic and/or inorganic additives such as 0.5% HDPE (High Density PolyEthylene) so as to improve metal release. In one example, the PEI may be a copolymer of polyetherimide (PEI) and siloxane.

Figure 3:
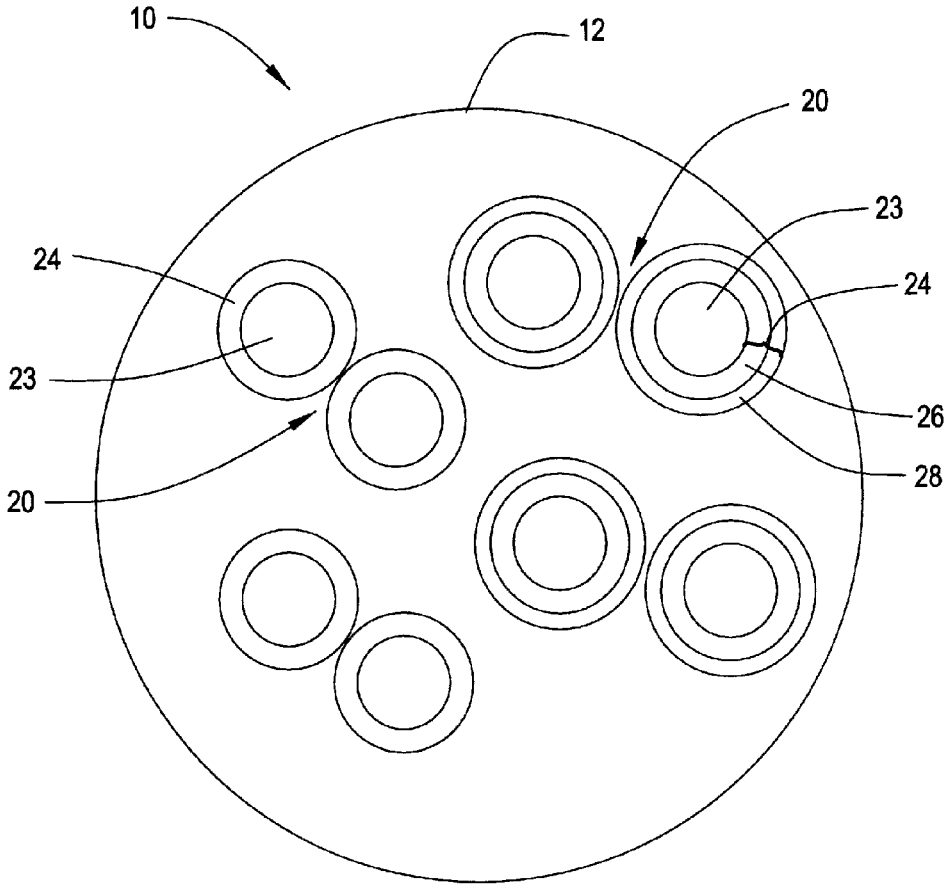
FIGS. 3-6 show exemplary cross sections of a LAN cable as in claim 1, according to different embodiments.

Based on these combined factors, according to one arrangement, as shown in FIG. 3, on two twisted pairs 20, insulation 24 is a single layer of insulation of FRPP which has good electrical properties and good mechanical properties while providing a low cost solution to provide flame retardant insulation for primary conductors 22.

In order to provide improved smoke/fire resistance, the other two pairs 20 are insulated with the two layer insulation 26/28 of PEI over FRPP as shown in FIG. 2. These two pairs using dual layer 26/28 insulation in cable 10, provide cable 10 with significantly increased fire resistance such that the result is that, overall, cable 10 is able to meet more stringent smoke/fire testing standards without the use of any FEP. The added stiffness from using PEI over FRPP on two pairs 20 is offset by the flexibility of the other two pairs 20 insulated with FRPP alone as layer 24 and thus does not significantly impair the flexibility of cable 10.

Figure 4:
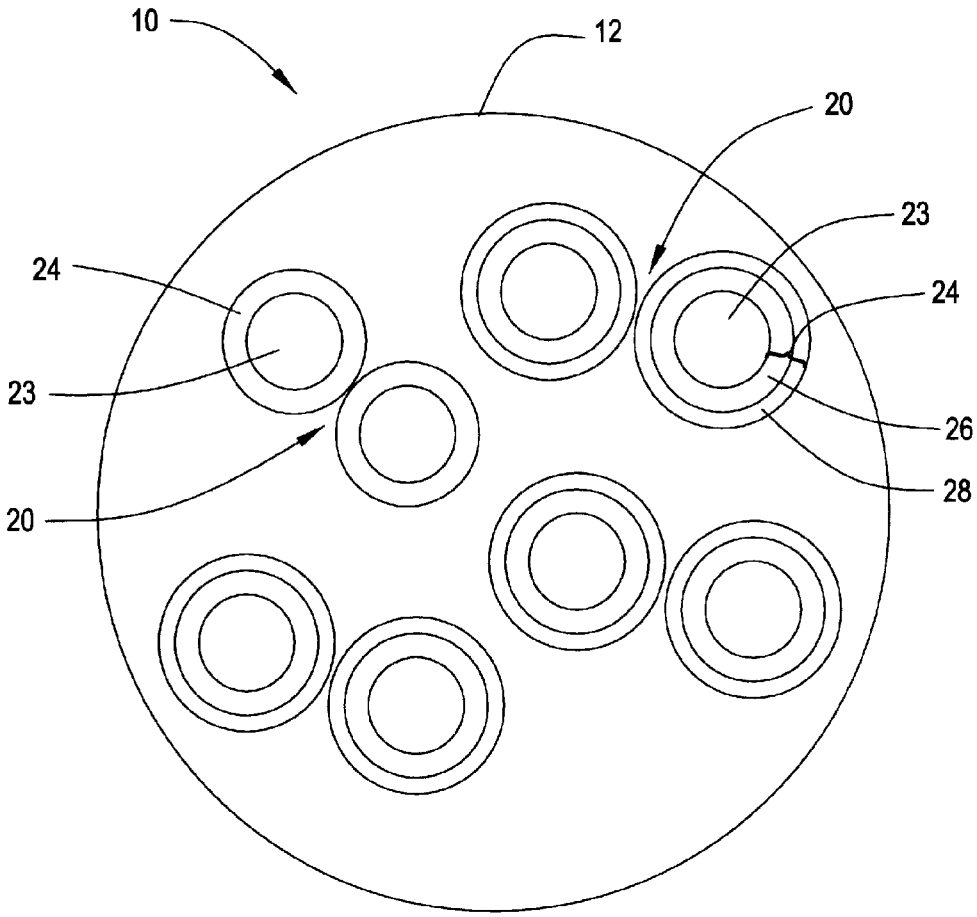

In an alternative arrangement, as shown in FIG. 4, instead of splitting the pairs 20 of cable 10 equally, only one twisted pairs 20 is insulated with a single layer 24 of FRPP and other three pairs 20 are insulated with the two layer insulation 26/28 of PEI over FRPP as shown in FIG. 2.

Figure 5:
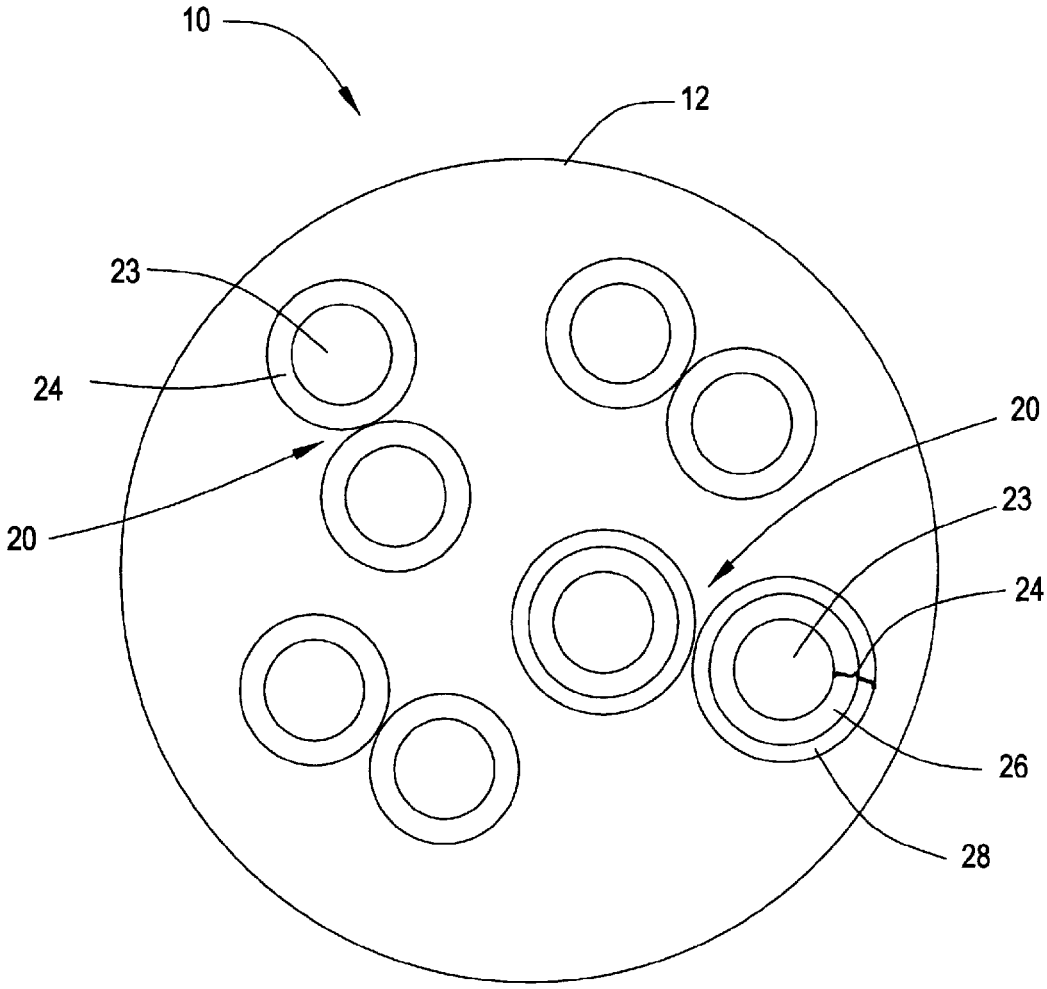

In another alternative arrangement, as shown in FIG. 5, instead of splitting the pairs 20 of cable 10 equally, three twisted pairs 20 are insulated with a single layer 24 of FRPP and other remaining pair 20 is insulated with the two layer insulation 26/28 of PEI over FRPP as shown in FIG. 2.

Figure 6:
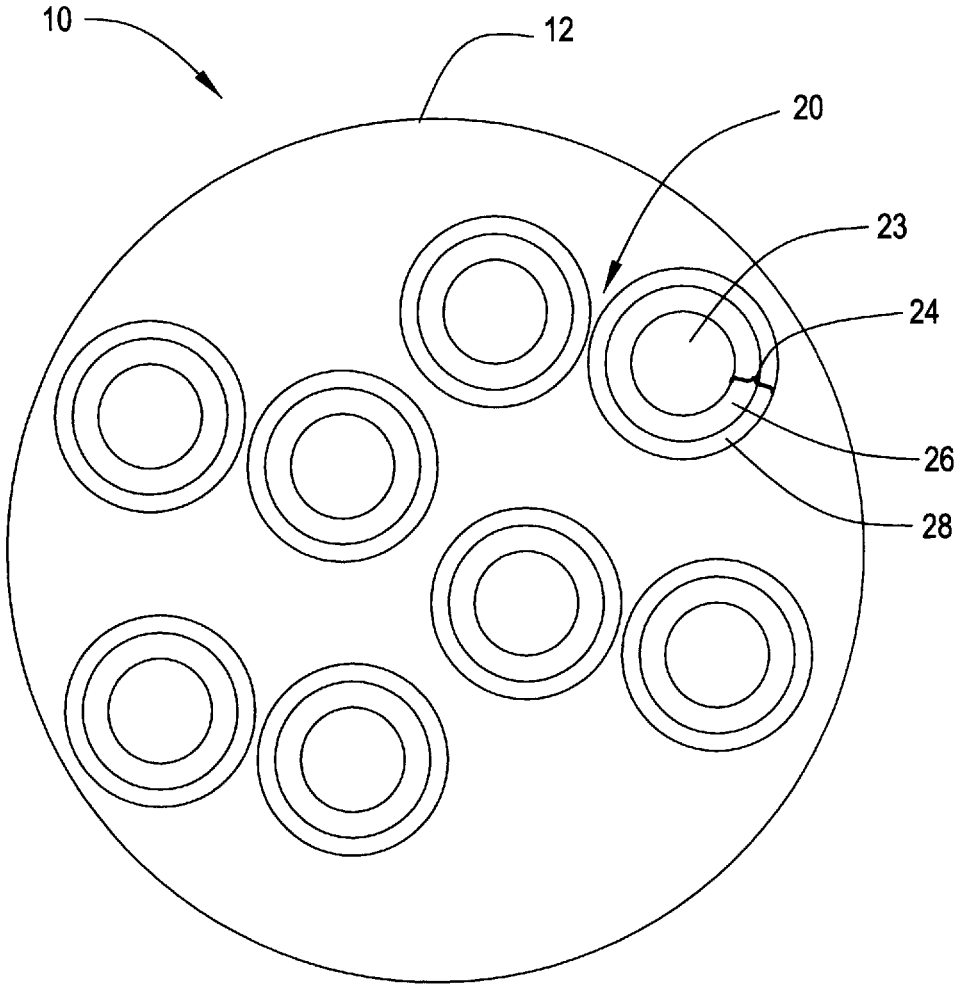

Finally, in another alternative arrangement, as shown in FIG. 6, as instead of splitting the pairs 20 of cable 10 equally, all four of twisted pairs 20 are insulated with the two layer insulation 26/28 of PEI over FRPP as shown in FIG. 2.

Turning to test results for the present arrangement, the above described NFPA 262 flame test is applied to cables, such as cable 10, intended for use within buildings inside of ducts, plenums, or other spaces used for environmental air distribution. Any cable used in these areas must be "plenum rated" in order to be installed without conduit. On such plenum rating test is the NFPA 262 test. In order to pass the NFPA 262 test, these cables must have outstanding resistance to flame spread and generate low levels of smoke during combustion. As noted above, this smoke spread factor is directly related to the use of insulation on cable 10, and in particular the insulation used on twisted pairs 20. Because of the need to use low smoke insulation, these plenum rated cables are the highest in cost of the three major premise data communications cable types specified by the NEC (National Electric Code).

The NFPA 262 flame test uses a test apparatus called a Steiner Tunnel. The set up includes a chamber that is 25 long by 18 inches wide by 12 inches high. An 11.25 inch wide tray is loaded with a single layer of cable, such as cable 10 placed side to side against each other so that the width of the tray is filled. The cable is then exposed to a 300,000 btu flame for 20 minutes. During the course of the test, the flame must not propagate more than 5 feet, the peak smoke must not exceed a value of 0.5 (log Io/I), and the average smoke value must not exceed 0.15 (log Io/I). It is noted that log Io/I refers to the optical density where I is the intensity of light at a specified wavelength $\lambda$ that has passed through a sample (transmitted light intensity) and $I_0$ is the intensity of the light before it enters the sample or incident light intensity (or power). If the cable is tested twice meets all three criteria after each test, it is deemed to have passed the test.

As indicated above, the use of PEI in the various explained embodiments shown above in FIGS. 3-6, owing to its good fire resistance properties, allows cable 10 to meet the NFPA 262 test, even with the use of the lower cost FRPP on one or more of twisted pairs 20.

While only certain features of the invention have been illustrated and described herein, many modifications, substitutions, changes or equivalents will now occur to those skilled in the art. It is therefore, to be understood that this application is intended to cover ail such modifications and changes that fall within the true spirit of the invention.

What is claimed is:

1. A plenum rated communications cable, said cable comprising:

a jacket;

a first plurality of twisted pairs, each twisted pair having two conductors, insulated with a single layer of insulation, twisted around one another, a second plurality of twisted pairs, each twisted pair having two conductors, insulated with a dual layer of insulation, twisted around one another, wherein said single layer of insulation on said conductors of said first plurality of twisted pairs is made from FRPP (Flame Resistant Poly Propylene) and wherein said dual layer insulation on said conductors of said second plurality of twisted pairs includes a first inner layer of FRPP (Flame Resistant Poly Propylene) and a second outer layer of PEI (Polyetherimide), wherein said combination of said first plurality of twisted pairs and said second plurality of twisted pairs are such that said cable meets the NFPA 262 flame test, and wherein said cable includes a sufficient quantity of said first plurality of twisted pairs, so as not to impair flexibility of said cable.

2. The communication cable as claimed in claim 1, wherein said jacket is constructed of FRPVC (Flame Resistant Poly-Vinyl Chloride).

3. The communication cable as claimed in claim 1, wherein said first and second pluralities of twisted pairs are four twisted pairs within said jacket to form a LAN (Local Area Network) cable.

4. The communication cable as claimed in claim 1, wherein there is no FEP insulation used in said cable.

5. The communication cable as claimed in claim 1, wherein said second outer layer of PEI (Polyetherimide) contains 0.5% HDPE.

* * * * *